US008573192B2

(12) United States Patent
Bednar et al.

(10) Patent No.: US 8,573,192 B2
(45) Date of Patent: Nov. 5, 2013

(54) PORTABLE COCKING DEVICE

(75) Inventors: Richard L. Bednar, Munroe Falls, OH (US); Michael J. Shaffer, Mogadore, OH (US); Jacob A. Hout, Akron, OH (US)

(73) Assignee: Hunter's Manufacturing Company, Inc., Suffield, OH (US)

( * ) Notice: Subject to any disclaimer, the term of this patent is extended or adjusted under 35 U.S.C. 154(b) by 346 days.

(21) Appl. No.: 12/892,185

(22) Filed: Sep. 28, 2010

(65) Prior Publication Data

US 2011/0232619 A1 Sep. 29, 2011

Related U.S. Application Data

(60) Provisional application No. 61/258,303, filed on Nov. 5, 2009.

(51) Int. Cl.
*F41B 5/12* (2006.01)

(52) U.S. Cl.
USPC ..... 124/86; 124/25

(58) Field of Classification Search
USPC ..... 124/25, 86
See application file for complete search history.

(56) References Cited

U.S. PATENT DOCUMENTS

| | | | | |
|---|---|---|---|---|
| 706,697 | A * | 8/1902 | Sims | 242/379.2 |
| 1,051,914 | A * | 2/1913 | Prochnow | 42/85 |
| 2,776,644 | A * | 1/1957 | Fontaine | 119/796 |
| 5,243,956 | A * | 9/1993 | Luehring | 124/86 |
| 5,513,785 | A * | 5/1996 | Campagna, Jr. | 224/162 |
| 5,746,192 | A * | 5/1998 | Gissel | 124/1 |
| 6,913,007 | B2 * | 7/2005 | Bednar | 124/25 |
| 7,624,725 | B1 * | 12/2009 | Choma | 124/25 |
| 2005/0022799 | A1 * | 2/2005 | Bednar | 124/25 |
| 2005/0066928 | A1 * | 3/2005 | Vick et al. | 123/185.2 |
| 2006/0037682 | A1 * | 2/2006 | Reiter | 150/107 |
| 2006/0086346 | A1 * | 4/2006 | Middleton | 124/25 |
| 2012/0037139 | A1 * | 2/2012 | Barnett | 124/86 |

OTHER PUBLICATIONS

Canadian Office Action; application No. 2,716,632; dated Apr. 10, 2013.

* cited by examiner

*Primary Examiner* — Gene Kim
*Assistant Examiner* — John E Simms, Jr.
(74) *Attorney, Agent, or Firm* — John Skeriotis; Emerson Thomson Bennett, LLC

(57) ABSTRACT

A portable device for drawing the bowstring of a crossbow. The cocking device may be designed to prevent the uneven drawing of the crossbow and may eliminate the complex installation process typically required to retro-fit an existing crossbow with known cocking devices.

15 Claims, 12 Drawing Sheets

PORTABLE COCKING DEVICE

This application claims priority to provisional patent application Ser. No. 61/258,303 titled Portable Cocking Device, filed on Nov. 5, 2009, which is incorporated herein by reference.

BACKGROUND

A. Field of Invention

This invention pertains to the art of methods and apparatuses of bowstring drawing devices and even more particularly, to the art of methods and apparatuses of portable cocking devices for drawing a bowstring of a crossbow.

B. Description of the Related Art

It is known to increase the speed and accuracy at which a projectile is propelled from an archery device is to increase the stiffness of the outwardly extending bow limbs. However, increasing the stiffness of the outwardly extending bow limbs results in an increase in the effort or force required when pulling or drawing the bowstring into position for firing. At some point, simply increasing the stiffness of the outwardly extending bow arms becomes counterproductive since users do not have the physical strength to pull back or draw the bowstring into position for firing and maintain this position until the user has sighted his or her target and is ready to release the bowstring. Furthermore, if the user is struggling to maintain the drawn position of the bowstring, his or her aim will be negatively affected.

In a crossbow, a longitudinally extending main beam, commonly called the stock, includes a trigger mechanism which holds the bowstring in the drawn position, allowing the user to sight a target without manually holding and maintaining the draw weight. This allows the stiffness of the bow limbs to be increased significantly, and modern crossbows can have bowstring pull weights of 150 pounds or more. Although the trigger maintains the drawn position of the bowstring, drawing the bowstring into engagement with the trigger mechanism is still very difficult. It is readily apparent that with high pull weights, even operating a crossbow could be difficult, if not impossible, for many users having limited physical strength. This is particularly true for target practice or other situations where the crossbow is cocked numerous times.

In order to draw the crossbow bowstring and cock the crossbow, the user must have sufficient physical strength to draw the full bowstring draw weight of the crossbow. Devices have been used in conjunction with crossbows to make this cocking operation easier for users to accomplish. For example, some crossbows include a stirrup, which is mounted to one end of the crossbow. In such crossbows, the user places the stirrup onto the ground and places a foot onto the stirrup to support the crossbow for cocking. By applying the user's body weight to the grounded stirrup, the user can draw the crossbow bowstring into cocked position. Although helpful, this provides only limited advantage. In addition, it is very difficult to properly draw the bowstring in a manner that the limbs are each tensioned to the same degree, or the bow is drawn in a balanced manner relative to the outwardly extending limbs of the crossbow such that when the bowstring is released from the crossbow trigger mechanism, an equalized force will be imparted to the projectile or arrow positioned therein. This balancing of the forces imparted on the bowstring by means of the crossbow limbs is particularly important for shooting accuracy in using the crossbow, and also adds to safety of use.

Although known crossbow bowstring cocking devices work well for their intended purpose, conventional manual crank winch devices and leverage-type cocking devices are often large, heavy, and cumbersome and commonly must be connected and disconnected from the crossbow with each use. In many cases instead of simplifying the cocking procedure, these known devices add complexity or cost, are too cumbersome to handle and use effectively, and/or fail to ensure that the bowstring is drawn in a balanced manner. It remains desirable to develop cocking devices that are small, light, or not cumbersome, or which draw the bowstring in a balanced manner.

II. SUMMARY OF THE INVENTION

According to one embodiment of the present subject matter, a device may comprise a first handle, a second handle, a housing, a first hook member, and a second hook member. The first handle may be connected to a first end of a flexible member. The second handle may be operatively connected to the flexible member. The first and second handles are adapted to be grasped by a user. The housing may comprise a retraction device operatively connected to a second end of the flexible member. The retraction device may be adapted to retract at least a portion of the flexible member into an interior portion defined by the housing. The first hook member may be slidably coupled to the flexible member. The first hook member may comprise a first attachment assembly and a first coupling assembly. The second hook member may be slidably coupled to the flexible member. The second hook member may comprise a second attachment assembly and a second coupling assembly. The first and second hook members may be positioned between the first and second handles. The first and second attachment assemblies may be adapted to receive at least a portion of a bowstring of a crossbow and the first and second coupling assemblies may be adapted to at least partially enable the movement of the first and second hook members along at least a portion of the flexible member.

According to one embodiment of the present subject matter, a kit may comprise a crossbow and a cocking device. The crossbow may comprise a main beam including a stock having a butt portion and a barrel having an upper surface suitable for receiving an arrow to be fired from the crossbow; a pair of outwardly extending bow limbs operatively coupled to the distal end of the barrel; a bowstring operatively connected between the bow limbs; and, a trigger mechanism operatively coupled to the main beam, wherein the bowstring may be drawn rearward across the upper surface of the barrel and retained by the trigger mechanism such that the bowstring can be selectively released to propel the arrow from the crossbow. The cocking device may comprise a first handle, a second handle, a housing, a first hook member, and a second hook member. The first handle may be connected to a first end of a flexible member. The second handle may be operatively connected to the flexible member. The first and second handles are adapted to be grasped by a user. The housing may comprise a retraction device operatively connected to a second end of the flexible member. The retraction device may be adapted to retract at least a portion of the flexible member into the housing. The first hook member may be slidably coupled to the flexible member. The first hook member may comprise a first attachment assembly and a first coupling assembly. The second hook member may be slidably coupled to the flexible member. The second hook member may comprise a second attachment assembly and a second coupling assembly. The first and second hook members may be positioned between the first and second handles. The first and second attachment assemblies may be adapted to receive at least a portion of a bowstring of a crossbow and the first and second coupling assemblies may be adapted to at least partially enable the movement of the first and second hook members along at least a portion of the flexible member.

According to one embodiment of the present subject matter, a method may comprise the steps of: (a) providing a crossbow; (b) providing a cocking device; (c) attaching the first and second hook members to the bowstring; (d) adjusting the flexible member to cause a first length of the flexible member to extend between the first and second hook members; (e) positioning the first length around a portion of the main beam of the crossbow; (f) exerting a rearward force to draw the bowstring, wherein the rearward force is exerted by utilizing the first and second handles; (g) slidably moving the first hook member or the second hook member relative to the flexible member, wherein the movement of the first hook member or the second hook member allows the bowstring to be drawn in a balanced manner; (h) retaining the bowstring in the trigger mechanism; (i) disengaging the cocking device from the crossbow; and, (j) retracting the flexible member, wherein the retraction of the flexible member at least partially causes the cocking device to comprise a stowed position. The crossbow may comprise: a main beam including a stock having a butt portion and a barrel having an upper surface suitable for receiving an arrow to be fired from the crossbow; a pair of outwardly extending bow limbs operatively coupled to the distal end of the barrel; a bowstring operatively connected between the bow limbs; and, a trigger mechanism operatively coupled to the main beam. The bowstring may be drawn rearward across the upper surface of the barrel and retained by the trigger mechanism such that the bowstring can be selectively released to propel the arrow from the crossbow. The cocking device may comprise: a first handle, a second handle, a housing, a first hook member, and a second hook member. The first handle may be connected to a first end of a flexible member. The second handle may be operatively connected to the flexible member. The first and second handles are adapted to be grasped by a user. The housing may comprise a retraction device operatively connected to a second end of the flexible member. The retraction device may be adapted to retract at least a portion of the flexible member into the housing. The first hook member may be slidably coupled to the flexible member. The first hook member may comprise a first attachment assembly and a first coupling assembly. The second hook member may be slidably coupled to the flexible member. The second hook member may comprise a second attachment assembly and a second coupling assembly. The first and second hook members may be positioned between the first and second handles. The first and second attachment assemblies may be adapted to receive at least a portion of a bowstring of a crossbow and the first and second coupling assemblies may be adapted to at least partially enable the movement of the first and second hook members along at least a portion of the flexible member.

One advantage of the present subject matter is that it provides a portable, compact, lightweight, cost-effective device that is easy to use. Further, the portable cocking device eliminates the difficult or complex installation process associated with many conventional cocking devices.

Another advantage of the present subject matter is that it enables the bowstring to be drawn in a balanced manner relative to the outwardly extending limbs of the crossbow such that when the bowstring is released from the crossbow trigger mechanism, an equalized force will be imparted to the projectile or arrow positioned therein.

Still other benefits and advantages of the present subject matter will become apparent to those skilled in the art to which it pertains upon a reading and understanding of the following detailed specification.

III. BRIEF DESCRIPTION OF THE DRAWINGS

The subject matter described herein may take physical form in certain parts and arrangement of parts, a non-limiting embodiment of which will be described in detail in this specification and illustrated in the accompanying drawings which form a part hereof and wherein.

IV. DETAILED DESCRIPTION

Figure 1:
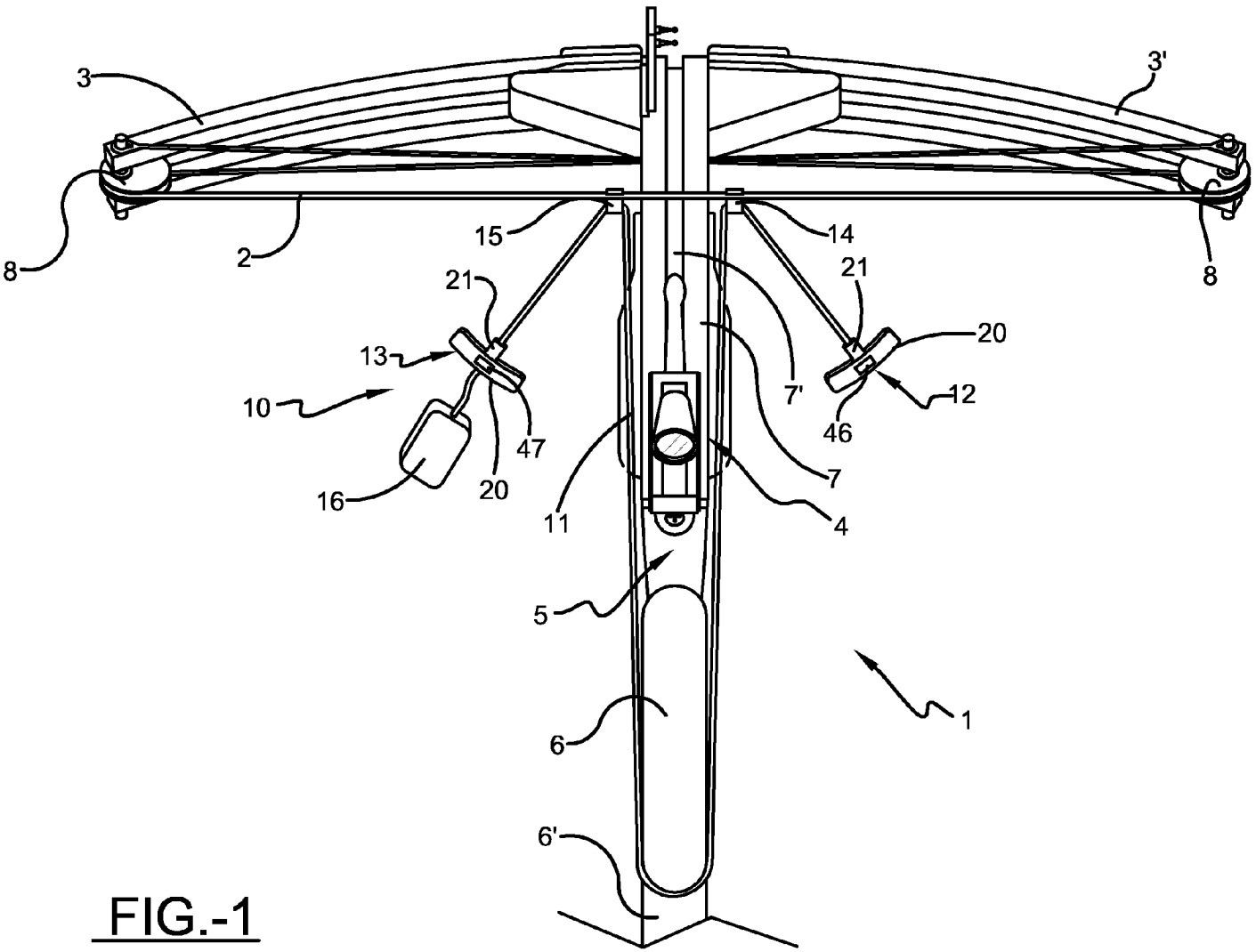
FIG. 1 shows a perspective view of one embodiment of a cocking device engaged with a bowstring of a crossbow.

Referring now to FIGS. 1-12 wherein the showings are for purposes of illustrating certain embodiments of the present subject matter only and are not for purposes of limiting the same, FIG. 1 shows a crossbow depicted generally at 1. The crossbow 1 may comprise a main beam 5. The main beam 5 may comprise of a stock 6 and a barrel 7. The stock 6 may comprise a butt portion 6' designed to be positioned against the shoulder of the associated user during firing of the crossbow 1. The barrel 7 may comprise an upper surface 7' suitable for receiving an arrow or bolt. A grip, not shown, may extend from the lower surface of the main beam 5 proximate to a trigger mechanism 4. The trigger mechanism 4 may be operatively coupled to the main beam 5 and may be adapted to retain and selectively release a bowstring 2 to propel an arrow or bolt from the crossbow 1. A pair of outwardly extending bow limbs 3, 3' may be operatively coupled to the distal end of the barrel 7. The bowstring 2 may be operatively connected to and extend between the ends of the bow limbs 3, 3'. In certain embodiments, the crossbow 1 may comprise a compound bow wherein the bowstring 2 may be received by cams or pulleys 8 rotatably coupled to the ends of the bow limbs 3, 3'. The crossbow 1 may be configured such that when the bowstring 2 is drawn back towards the butt portion 6' the bow limbs 3, 3' may flex or bend thereby storing potential energy in the crossbow 1. The bowstring 2 may be drawn rearwardly across the upper surface 7' until being received and selectively retained by the trigger mechanism 4. Although a certain embodiment of the crossbow is shown to describe a cocking device 10, the cocking device 10 may be utilized with any type of crossbow chosen with sound judgment by a person of ordinary skill in the art.

Figure 10:
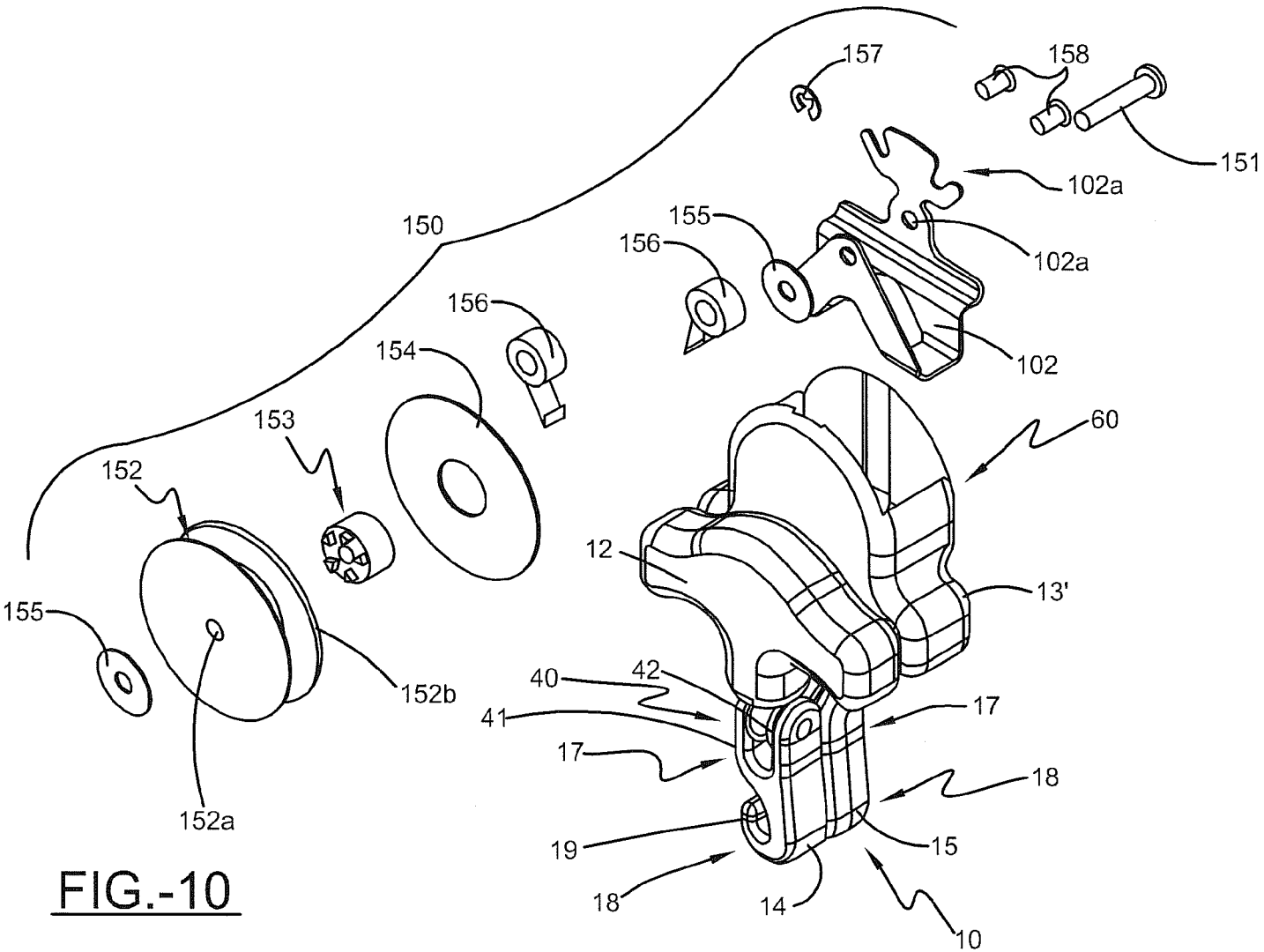
FIG. 10 shows a partial exploded view of a second embodiment of a cocking device to draw a bowstring of a crossbow.

With reference now to FIGS. 1, 2, 3, 4, and 10 the cocking device 10 may comprise a portable device that can be conveniently carried by the user and subsequently utilized to draw the bowstring 2 of the crossbow 1 in a balanced manner. The cocking device 10 may comprise a portable, compact, lightweight, cost-effective device that may be easy to use and may eliminate the difficult or complex installation process associated with many conventional crossbow bowstring cocking devices. The cocking device 10 may comprise a device that enables the bowstring 2 to be drawn in a balanced manner relative to the pair of outwardly extending bow limbs 3, 3' of the crossbow 1 such that when the bowstring 2 is released from the trigger mechanism 4, an equalized force will be imparted to an arrow or bolt positioned on the upper surface 7' of the barrel 7. In a first embodiment, as shown, without limitation, in FIGS. 2 and 3, the cocking device 10 may comprise first and second hook members 14, 15, a flexible member 11, first and second handles 12, 13, and a housing 16. In a second embodiment, as shown in FIG. 10, without limitation, the cocking device 10 may comprise first and second hook members 14, 15, a flexible member 11, first and second handles 12, 13'. The first and second hook members 14, 15 may comprise a first end having a coupling assembly 17 and a second end having an attachment assembly 18. The coupling assembly 17 may comprise a device adapted to slidably couple the first and second hook members 14, 15 to the flexible member 11. In one embodiment, the coupling assembly 17 may comprise a pulley assembly 40, shown in FIG. 4, comprising a block 41 and a sheave 42 positioned adjacent to the first end of the first and second hook members 14, 15. In another embodiment, the coupling assembly 17 may comprise a spindle, not shown, positioned at least partially within the first and second hook members 14, 15. The spindle, not shown, may be rotatably coupled to the first and second hook members 14, 15 and may define an aperture extending through the first end of the first and second hook members 14, 15 suitable for receiving the flexible member 11. In yet another embodiment, the coupling assembly may comprise a hollow ring, not shown, that defines an aperture formed through the first end of the first and second hook members 14, 15.

Figure 4:
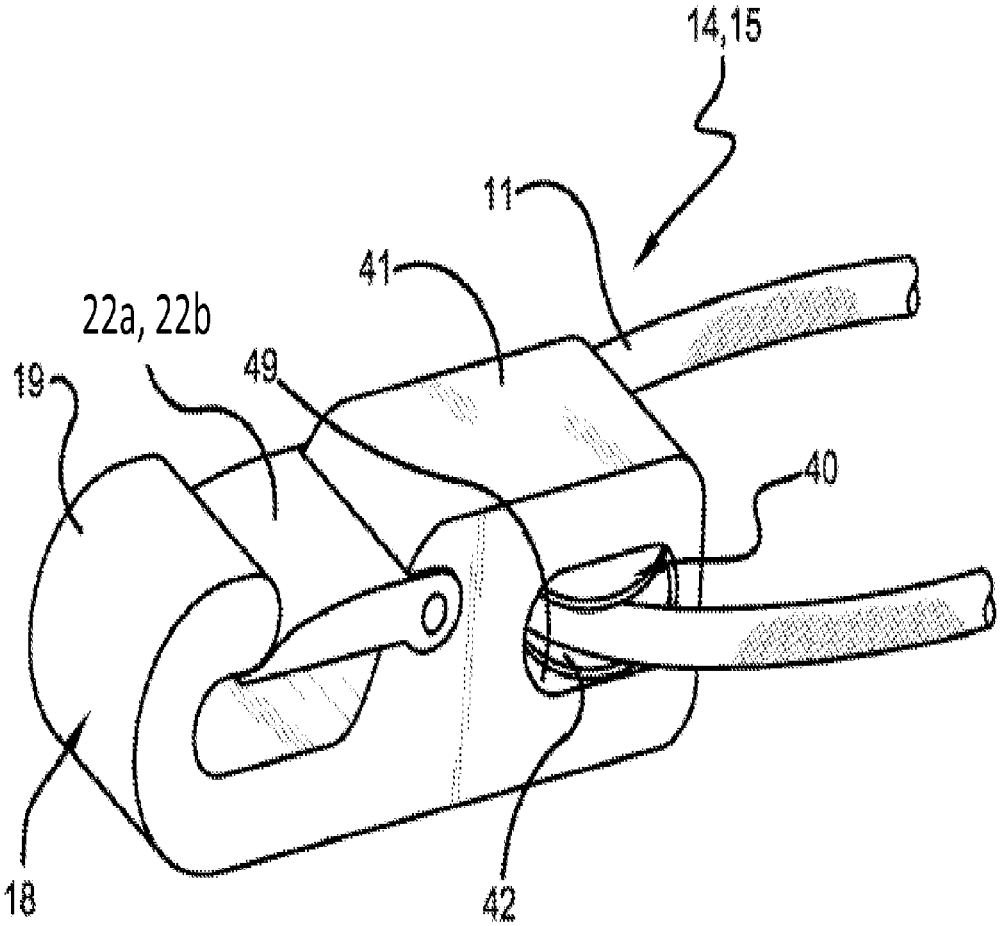
FIG. 4 shows a perspective view of a hook member.
Figure 5:
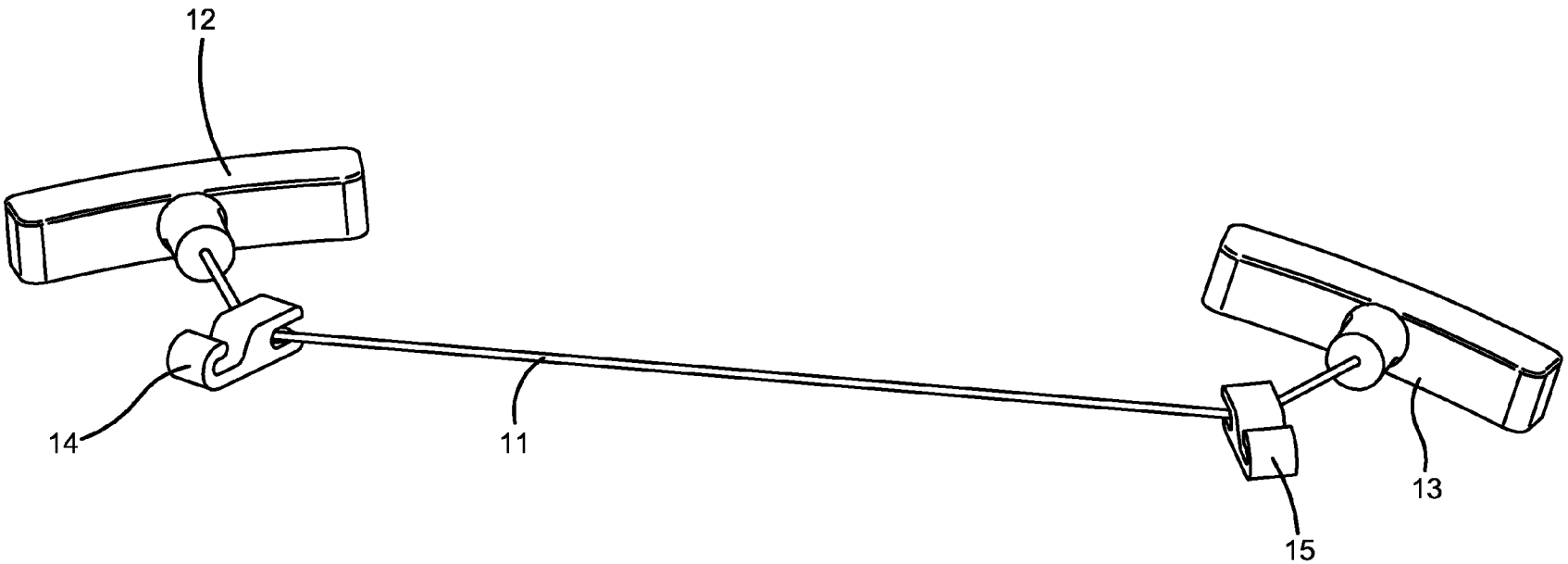
FIG. 5 shows a perspective view of an embodiment of a cocking device.
Figure 6:
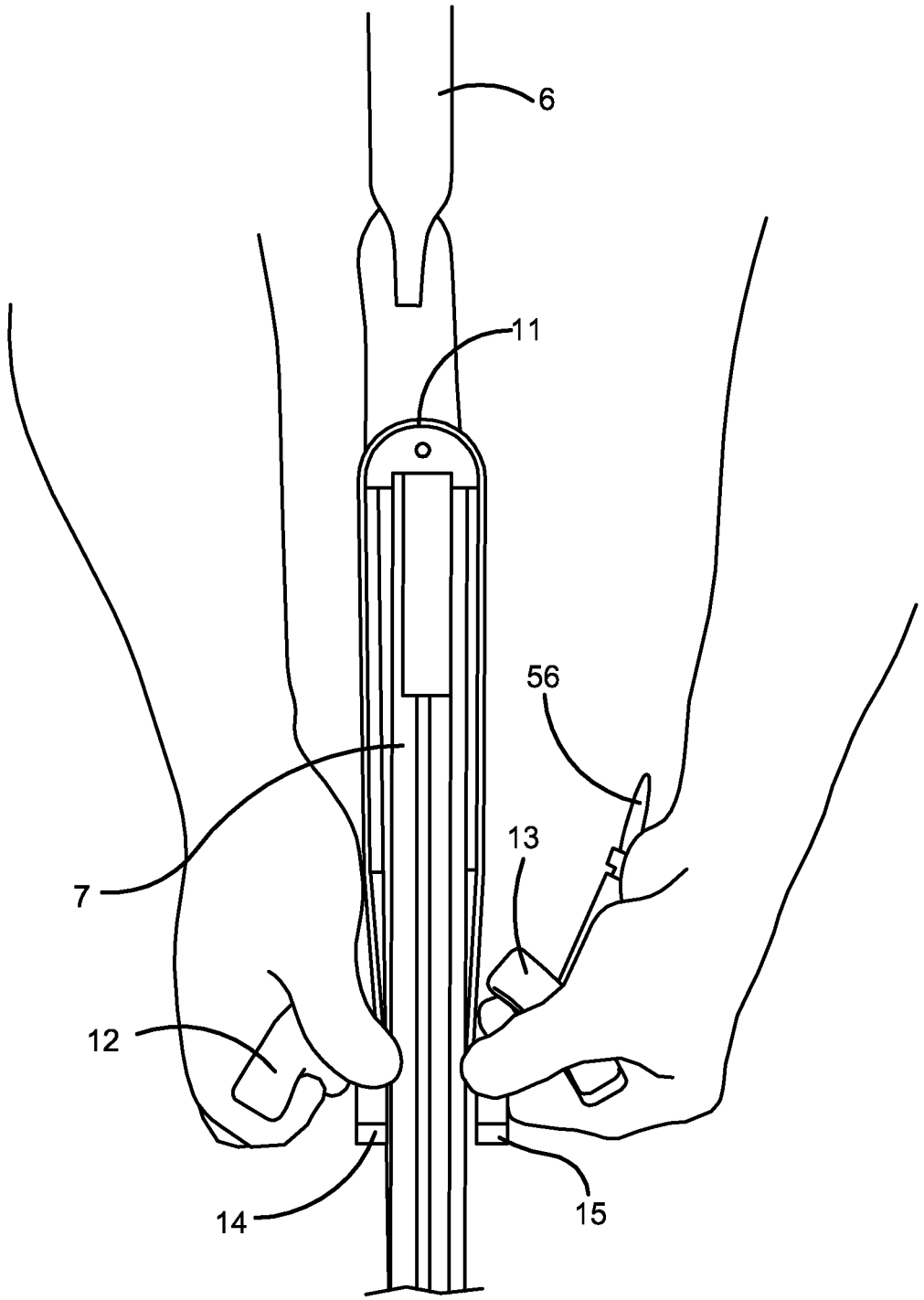
FIG. 6 shows a perspective view of an embodiment of a cocking device positioned around a portion of a crossbow to allow for the engagement and drawing of a bowstring.

With reference now to FIGS. 1 and 4, the attachment assembly 18 may be adapted to enable the selective attachment of the first and second hook members 14, 15 to the bowstring 2. In one embodiment, the attachment assembly 18 may comprise a hook-shaped appendage 19 extending from the second end of the attachment assembly 18. The hook-shaped appendage 19 may comprise a substantially U-shaped portion adapted to selectively engage the bowstring 2. The hook-shaped appendage 19 may be designed to be positioned about a portion of the bowstring 2 such that the bowstring 2 may be retained by the hook-shaped appendage 19 as the bowstring 2 is drawn rearward towards the trigger mechanism 4. Optionally, the hook-shaped appendage 19 may comprise a latch or similar device 22*a*, 22*b* that is pivotally connected to the attachment assembly 18 and biased to normally enclose the opening of the hook-shaped appendage 19 to at least partially assist in retaining the bowstring 2 as the bowstring 2 is being drawn.

Figure 2:
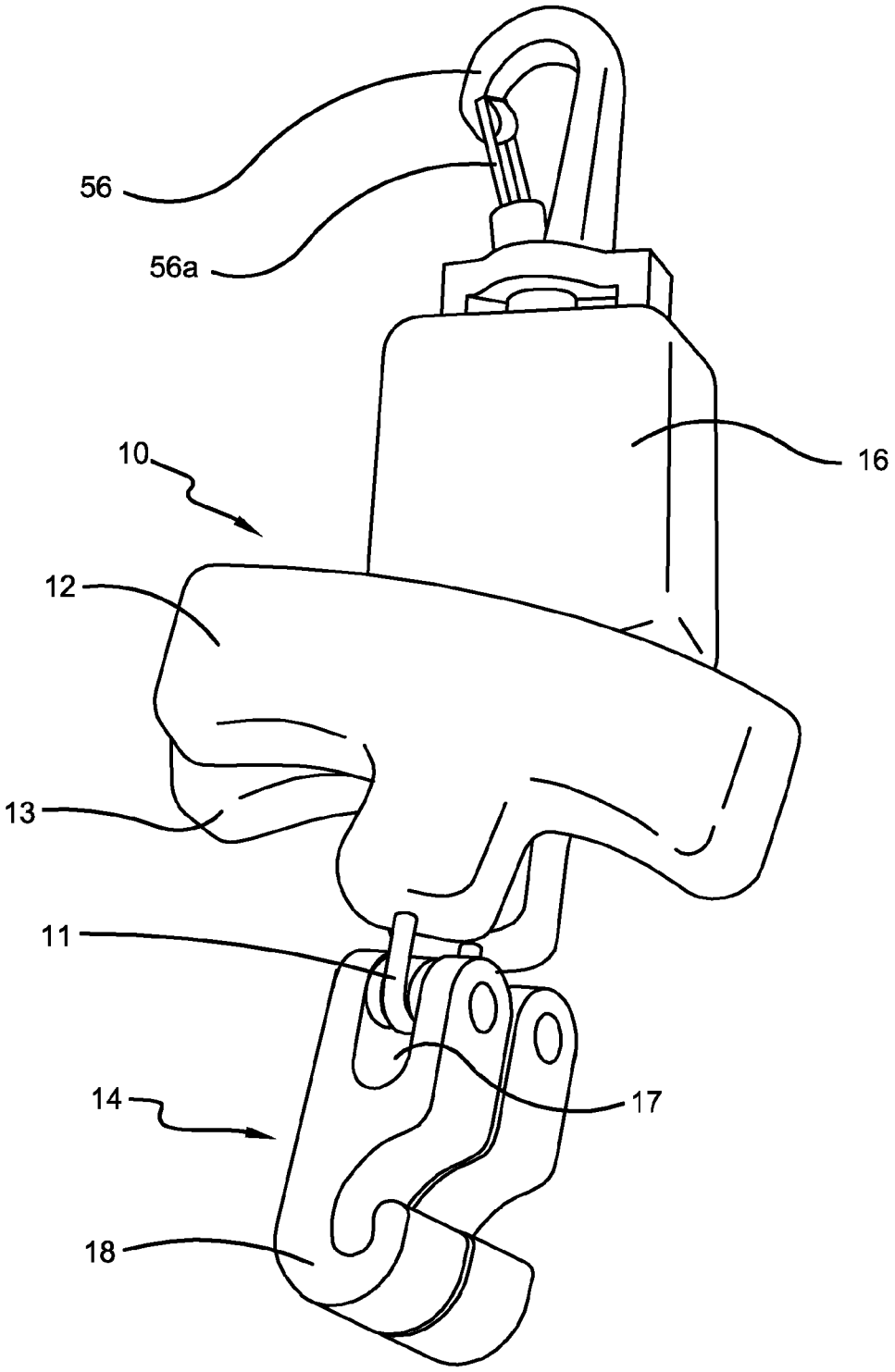
FIG. 2 shows a perspective view of an embodiment of a cocking device in a stowed position.
Figure 3:
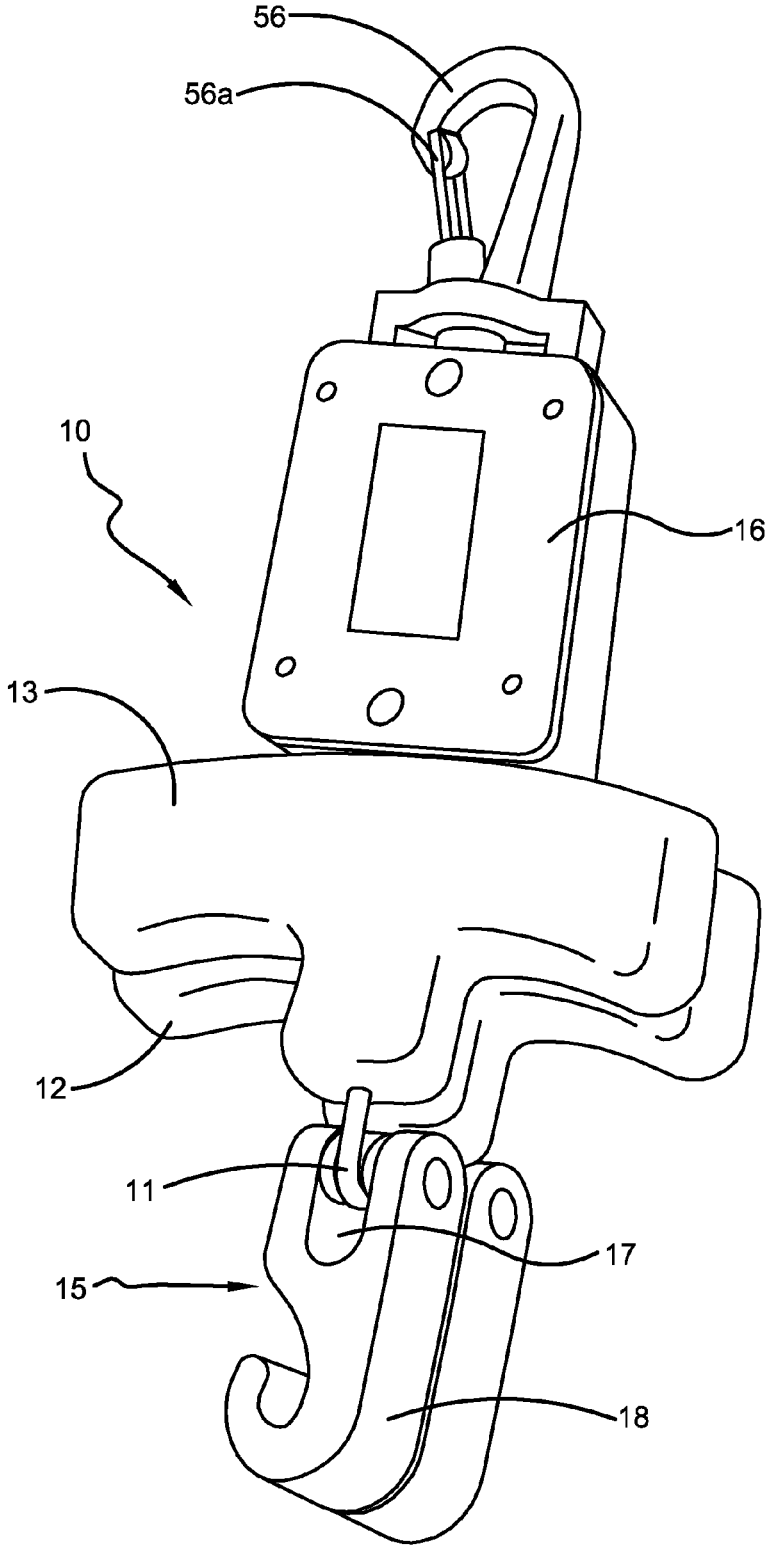
FIG. 3 shows a perspective view of an embodiment of a cocking device in a stowed position.

With reference to FIGS. 1-3, in a first embodiment, the first and second handles 12, 13 may be operatively connected to the flexible member 11 and may be adapted to be securely grasped by the associated user to draw the bowstring 2. In a first embodiment, the first and second handles 12, 13 may each comprise a T-shaped device having an upper portion 20 adapted to be grasped by the user when drawing the bowstring 2 of the crossbow 1 and a stem portion 21 extending substantially perpendicular therefrom. In a second embodiment, as shown in FIG. 10, the second handle 13' may comprise a substantially T-shaped device integrally engaged with a housing 60. The second embodiment may further comprise an upper portion 20 adapted to be grasped by the user when drawing the bowstring 2 of the crossbow 1 and a stem portion 21 extending substantially perpendicular therefrom. In certain embodiments, the handles may comprise or be replaced with elements adapted to engage with a user in an alternative manner. In certain embodiments, one or more of the handles 12, 13, or 13' may comprise or be replaced by a strap (not shown), a loop or appliance adapted for operational engagement with a user's wrist or elbow. In certain embodiments, one or more of the handles 12, 13, or 13' may comprise or be replaced by a device or appliance (not shown) adapted for operational engagement with a prosthetic hand or other prosthesis of the type sometimes used by some specially-abled users.

In either of a first or second embodiment, the first and second handles 12, 13 or 12, 13' may comprise first and second magnets 46, 47, respectively. The first and second magnets 46, 47 may comprise conventional magnets having a pair of oppositely charged poles and may be positioned within or coupled to the first and second handles 12, 13 or 12, 13'. The first and second magnets 46, 47 may be positioned within the first and second handles 12, 13 or 12, 13' such that when proximately located the first and second magnets 46, 47 may urge the first and second handles 12, 13 or 12, 13' into contact with each other. In one embodiment, the first and second magnets 46, 47 may be positioned within or coupled to the first and second handles 12, 13 or 12, 13' such that the poles of the first and second magnets 46, 47 extend along the longitudinal axis of the upper portion 20. In another embodiment, the first and second magnets 46, 47 may be positioned within or coupled to first and second handles 12, 13 or 12, 13' such that the poles of the first and second magnets 46, 47 extend along the longitudinal axis of the stem portion 21.

With reference now to FIGS. 1, 4, 7, and 10 the flexible member 11 may comprise a relatively flexible, elongated member, such as, for example, a rope, string, strap, cable, or woven chord, comprising elasticity and shock load properties suitable for being utilized to draw the bowstring 2.

In a first embodiment, the flexible member may comprise a first end 11*a* fixedly attached to the first handle 12 and a second end 11*b* operatively connected to the housing 16. The second handle 13 and the first and second hook members 14, 15 may be slidably coupled to the flexible member 11 such that the first and second hook members 14, 15 are positioned between the first and second handles 12, 13. In one embodiment, the flexible member 11 may extend through a channel 48 formed through the second handle 13. The channel 48 may comprise a diameter suitable to receive the flexible member 11 such that the second handle 13 can slide substantially freely along at least a portion of the flexible member 11. The channel 48 may extend through the substantial center of the second handle 13 substantially along the longitudinal axis of the stem portion 21. The flexible member 11 may be slidably coupled to the first and second hook members 14, 15 such that the flexible member 11 extends through the swallow 49 of the pulley assembly 40. Stated differently, the flexible member 11 may be slidably coupled to the first and second hook members 14, 15 such that the flexible member 11 extends through the space formed between the block 41 and the sheave 42 of the pulley assembly 40. In another embodiment, the flexible member 11 may extend through the aperture defined by the spindle, not shown, or through the hollow ring, not shown, positioned at least partially within the first end of the first and second hook members 14, 15.

Figure 11:
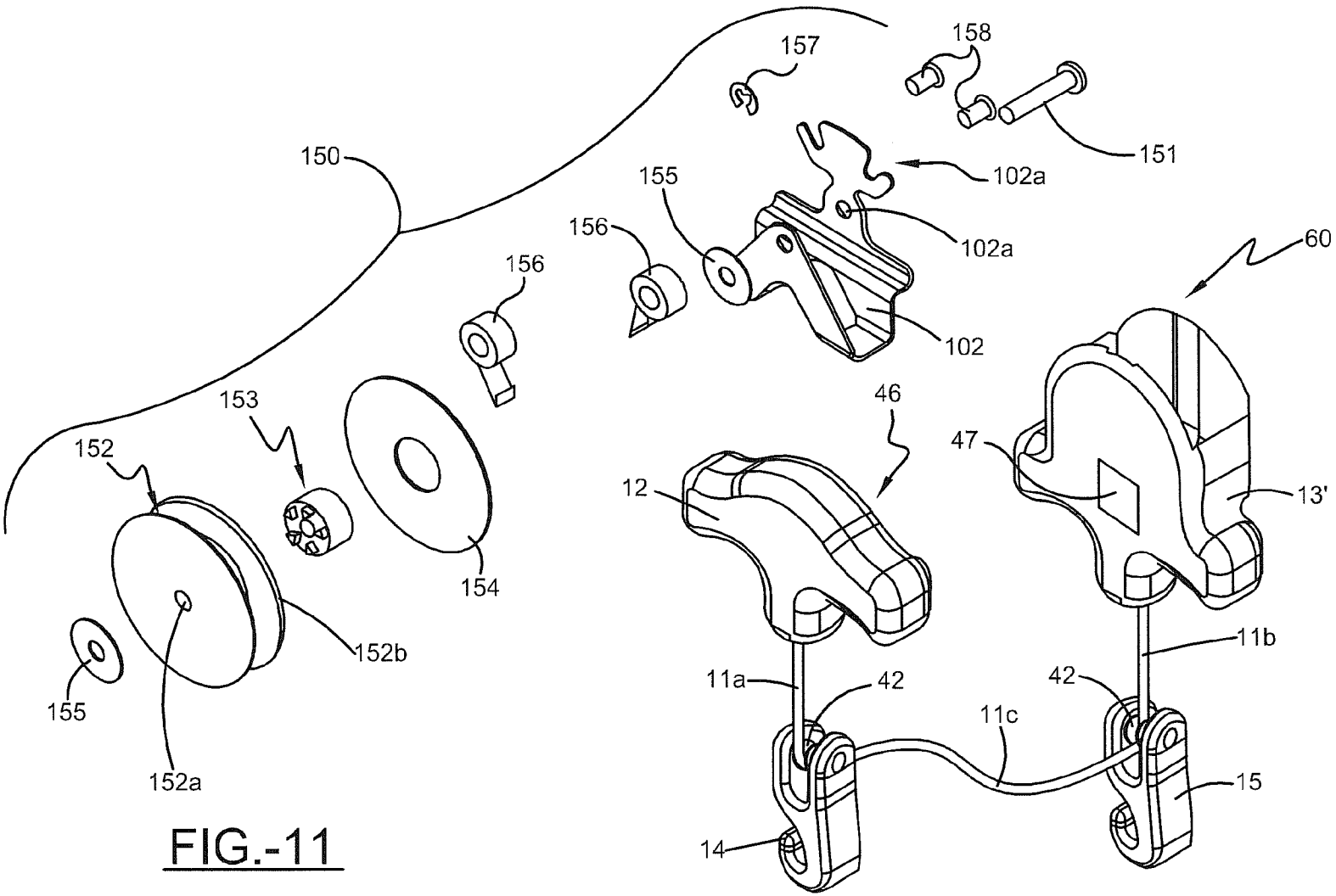
FIG. 11 shows a partial exploded view of a second embodiment of a cocking device to draw a bowstring of a crossbow.
Figure 12:
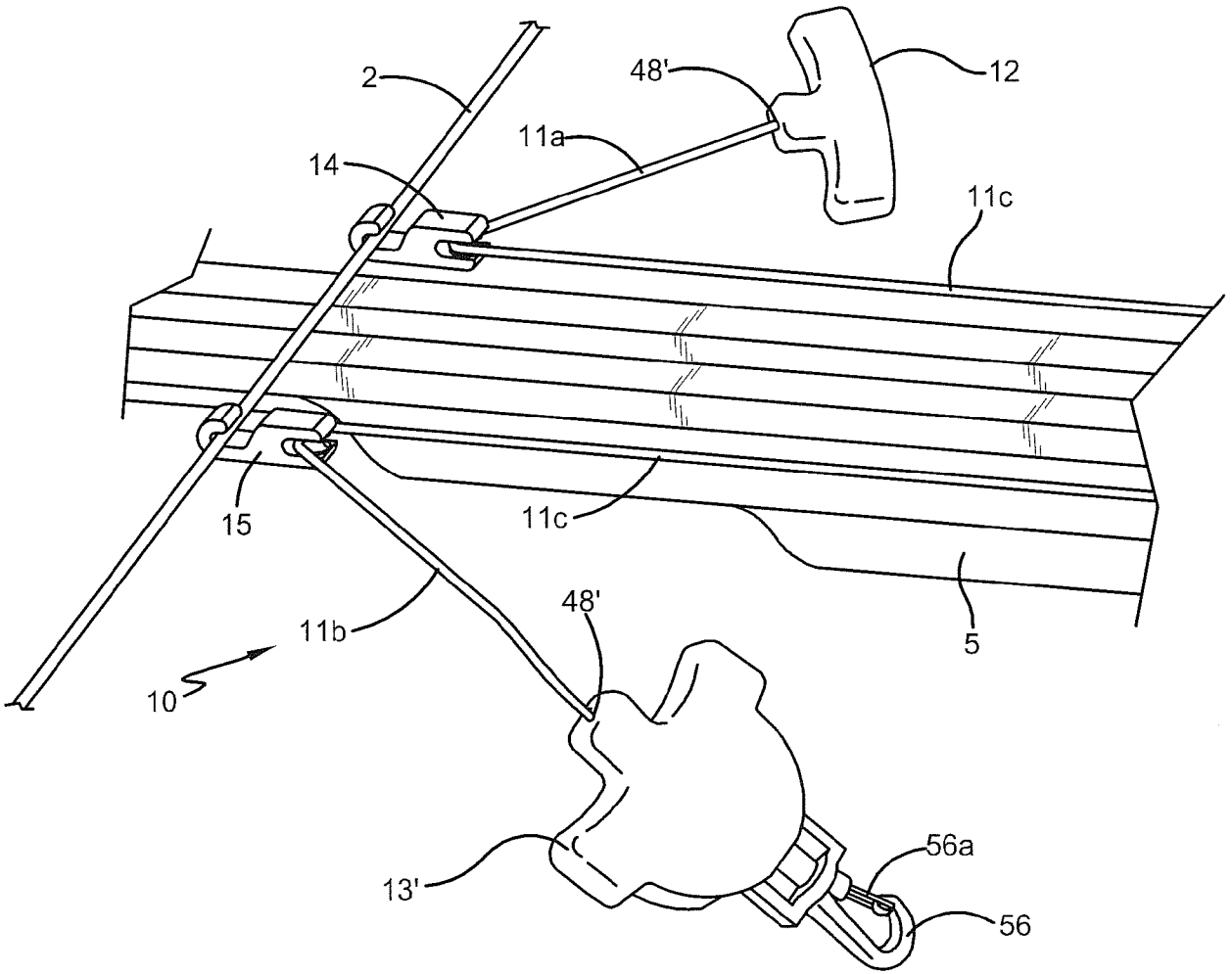
FIG. 12 shows a partial view of an embodiment of a crossbow having a cocking device engaged with the bowstring.

In a second embodiment, as shown in FIGS. 10, 11 and 12, the flexible member may comprise a first end 11*a* fixedly attached to the first handle 12 and a second end 11*b* operatively connected to the second handle 13'. The first and second hook members 14, 15 may be slidably coupled to the flexible member 11. In certain embodiments, when in a substantially fully stowed configuration, such as, without limitation, that shown in FIG. 10, the first and second hook members 14, 15 are positioned adjacent to the first and second handles 12, 13'. In certain embodiments, when in a deployed configuration, such as, without limitation, that shown in FIG. 12, the first and second hook members 14, 15 are positioned between the first and second handles 12, 13'. In certain embodiments, the first and second hook members 14, 15 are positioned along the flexible member 11 that connects the first and second handles 12, 13'. In one embodiment, the flexible member 11 may extend into a channel 48' communicating with the housing 60 of second handle 13'. The channel 48' may comprise a diameter suitable to receive the flexible member 11 such that the second handle 13 can accept at least a portion of the flexible member 11. The channel 48' may extend into the substantial center of the second handle 13 substantially along the longitudinal axis of the stem portion 21. The flexible member 11 may be slidably coupled to the first and second hook members 14, 15 such that the flexible member 11 extends through the swallow 49 of the pulley assembly 40. Stated differently, the flexible member 11 may be slidably coupled to the first and second hook members 14, 15 such that the flexible member 11 extends through the space formed between the block 41 and the sheave 42 of the pulley assembly 40. In another embodiment, the flexible member 11 may extend through the aperture defined by the spindle, not shown, or through the hollow ring, not shown, positioned at least partially within the first end of the first and second hook members 14, 15.

Figure 7:
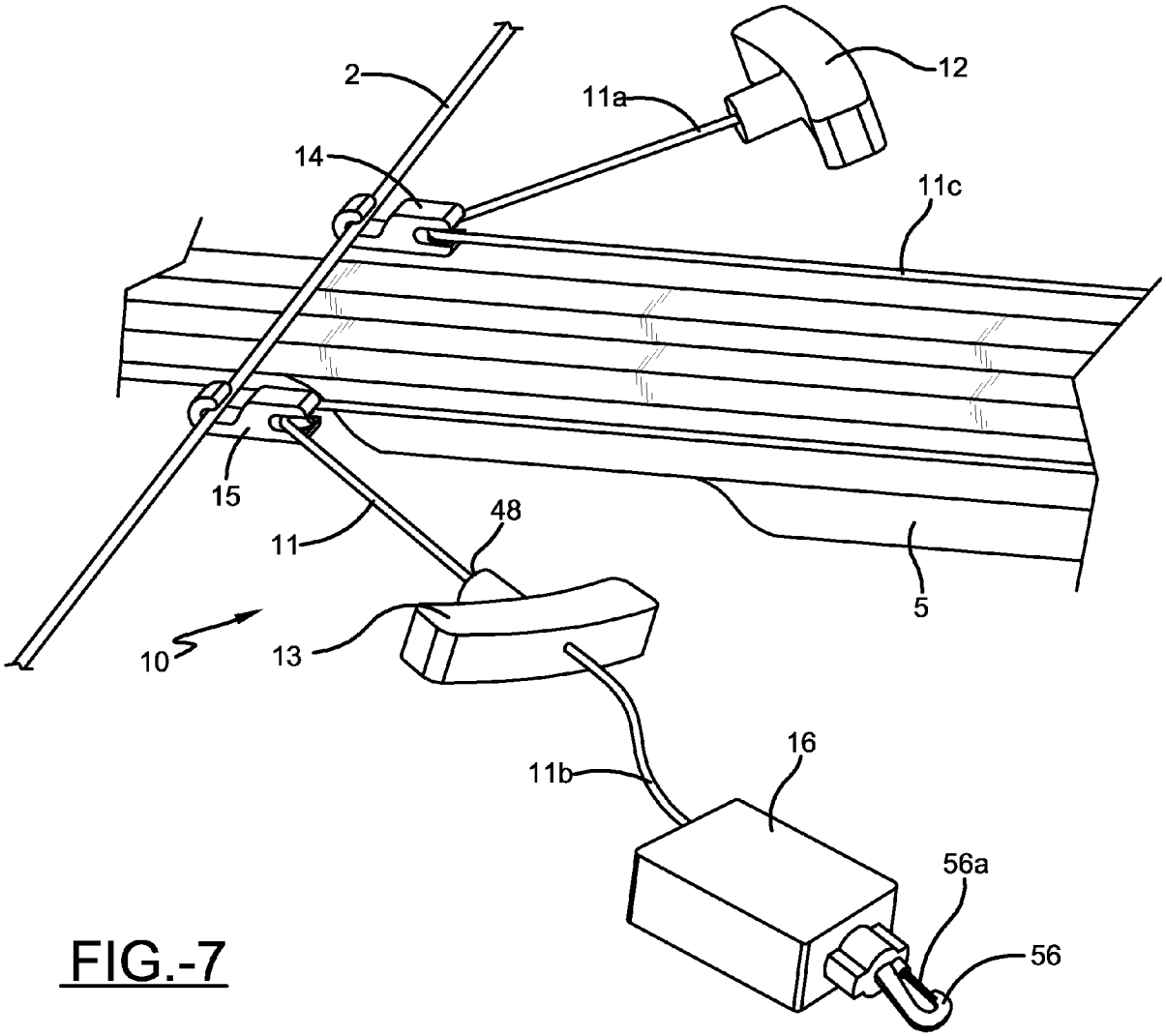
FIG. 7 shows a partial view of an embodiment of a crossbow having a cocking device engaged with the bowstring.
Figure 8:
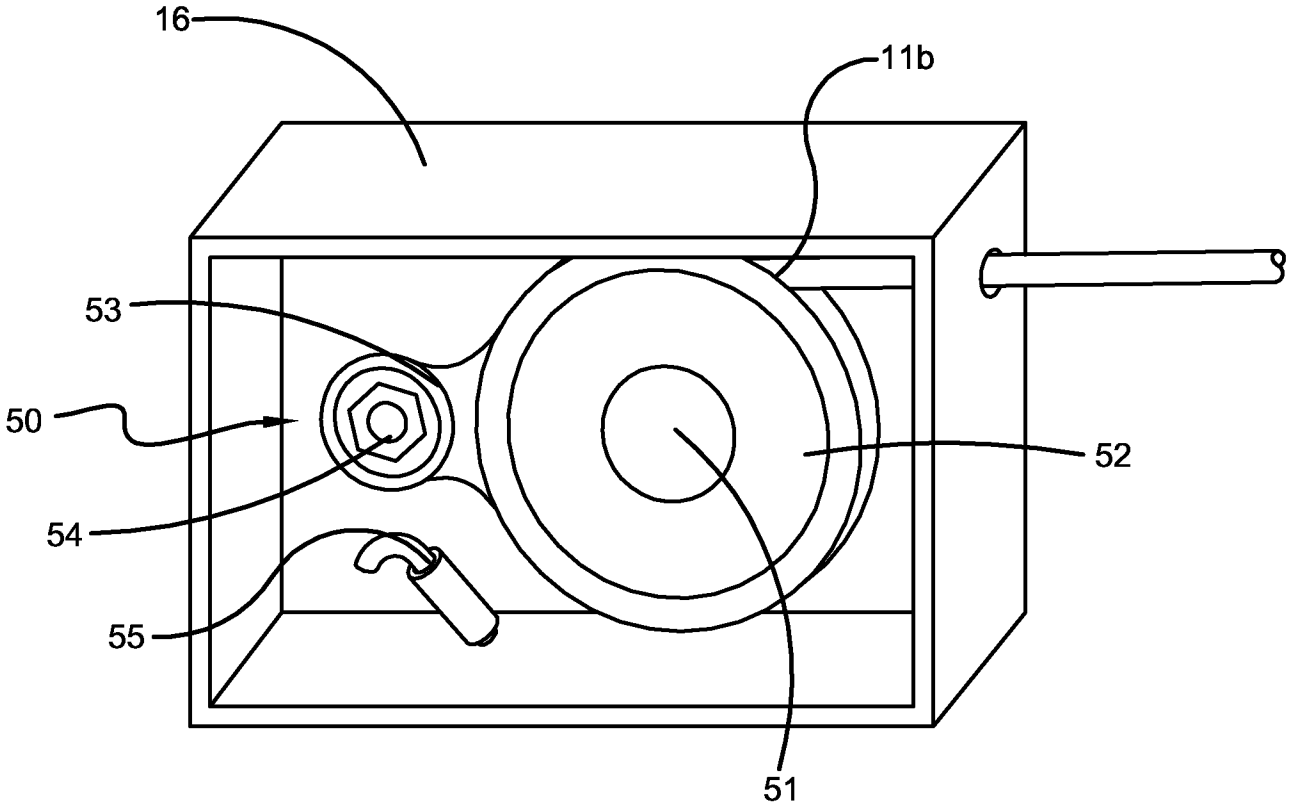
FIG. 8 shows a perspective view of an embodiment of a retraction mechanism of a cocking device.
Figure 9:
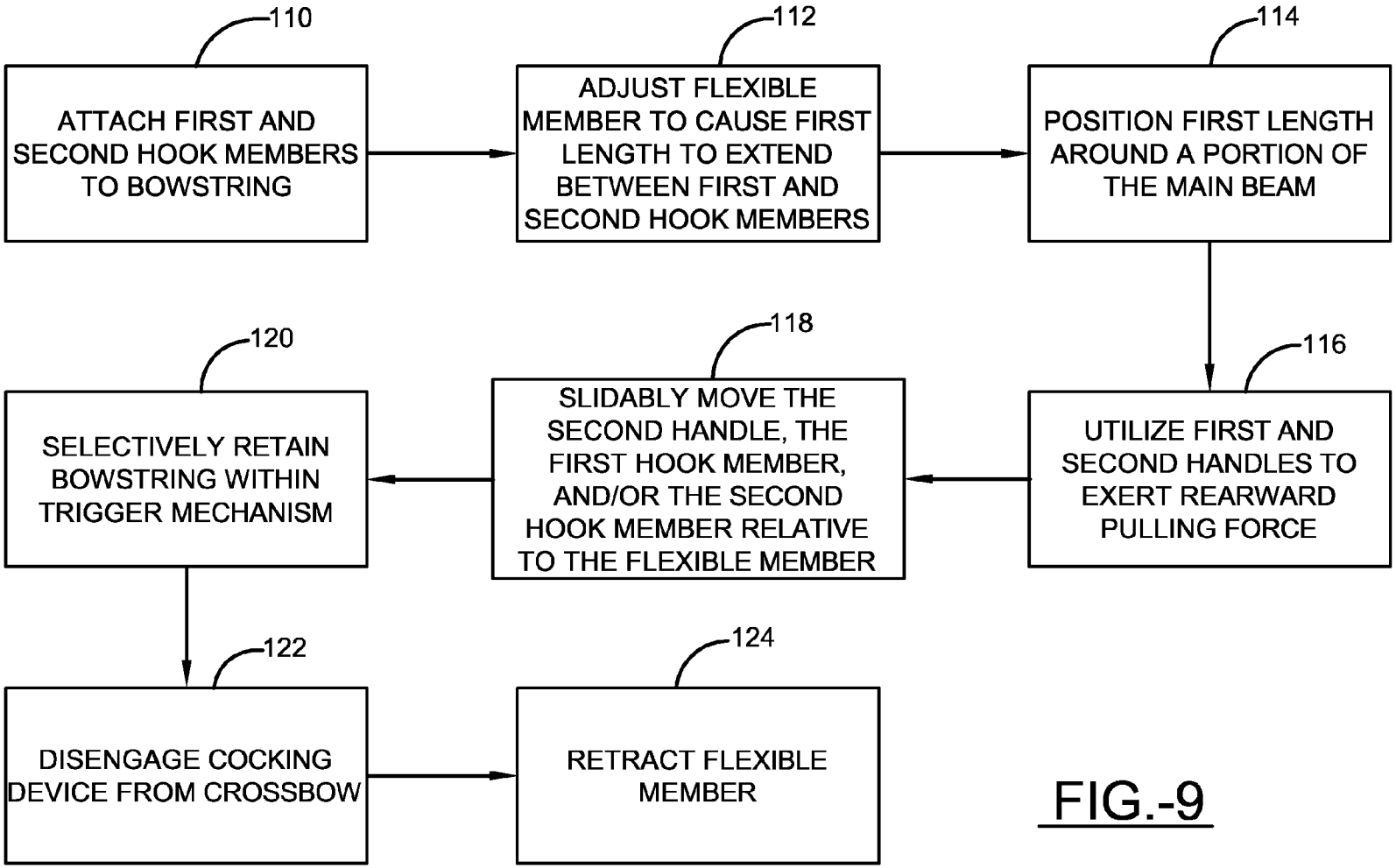
FIG. 9 shows a flow chart depicting one method for utilizing a cocking device to draw a bowstring of a crossbow.

With reference now to FIGS. 7 and 8, the housing 16 may be operatively coupled to the second end 11*b* of the flexible member 11. In one embodiment, the housing 16 may comprise a retraction device 50. The retraction device 50 may be positioned substantially within the housing 16 and may be adapted to selectively or automatically retract the flexible member 11 such that at least a portion of the flexible member 11 is positioned within the housing 16. In one embodiment, the retraction device 50 may comprise a shaft member 51 rotatably coupled to the housing 16. The shaft member 51 may comprise a pair of end plates 52 connected to the ends of the shaft member 51 such that the end plates 52 rotate in conjunction with the rotation of the shaft member 51. The end plates 52 may comprise a size and shape suitable for retaining the flexible member 11 as more fully described below. In one embodiment, the second end 11*b* of the flexible member 11 may be operatively connected to the shaft member 51. In a more specific embodiment, the second end 11*b* of the flexible member 11 may be fixedly connected to the shaft member 51. The retraction device 50 may further comprise a biasing member 53, such as, for example, a spring, operatively coupled to the shaft member 51 to enable the selective or automatic retraction of at least a portion of the flexible member 11. The biasing member 53 may urge the shaft member 51 to rotate in a first direction. The rotation of the shaft member 51 in the first direction may cause the flexible member 11 to be wound about the circumference of the shaft member 51 between the end plates 52 thereby causing the retraction of at least a portion of the flexible member 11 into the housing 16. In one embodiment, the retraction device 50 may comprise a ratchet gear 54 and a pawl 55. The ratchet gear 54 may comprise a separate member carried by shaft member 51 or may comprise one of the end plates 52. The ratchet gear 54 may cooperate with the pawl 55 to permit rotation of the shaft member 51 in one direction and to selectively prevent the rotation of the shaft member 51 in the opposite rotational direction. In one embodiment, the pawl 55 may be resiliently biased to a position between adjacent teeth formed about the circumference of the ratchet gear 54. The pawl 55 may comprise a distal end that extends from the housing 16 or is otherwise accessible to be selectively actuated by the user to cause the pawl 55 to be disengaged from the ratchet gear 54 thereby permitting the rotation of the shaft member in both rotational directions. In certain embodiments, the biasing member 53 may comprise a clock spring, a torsion spring, another type of spring, or similar mechanism which will operate to enable the selective or automatic retraction of at least a portion of the flexible member 11. In certain embodiments, the biasing member 53 may operate similarly to the springs in tape measures or other mechanisms adapted to permit selective or automatic rewinding of a component.

With reference now to FIG. 10, in a second embodiment, the second handle 13' may be operatively coupled to the second end 11*b* of the flexible member 11. In one embodiment, the second handle 13' may comprise a retraction device 150. In certain embodiments, the housing 60 operatively engaged with second handle 13' may comprise a retraction device 150. The retraction device 150 may be positioned substantially within the housing 60 and may be adapted to selectively or automatically retract the flexible member 11 such that at least a portion of the flexible member 11 is positioned within the housing 60. In certain embodiments, the retraction device 150 may be adapted to selectively or automatically retract substantially all of flexible member 11 with the exception of the portions of flexible member 11 that are wrapped about sheaves 42 of hooks 14 and 15. In certain embodiments, the retraction device 150 may comprise a frame element or cassette 102 adapted for insertion or installation within housing 60 of the second handle 13'. In certain embodiments, housing 60 may completely or substantially completely shroud or cover the retraction device 150. The cassette 102 may comprise one or more perforations, slots, or holes 102*a*, adapted to support or engage other components of the retraction device 150. As shown in FIG. 10, and without limitation, in certain embodiments, optional cassette 102 may be formed from folded sheet metal. In certain embodiments, optional cassette 102 may comprise holes or other adaptations to accept and rotatably engage a shaft member 151. In certain embodiments, optional cassette 102 is omitted and other components such as housing 60 or handle 13' may comprise holes or other adaptations to accept and rotatably engage a shaft member 151. In certain embodiments, a shaft member 151 may be adapted to rotatably retain a hub 152 placed thereon. A hub 152 may comprise a size and shape suitable for retaining the flexible member 11 as more fully described below. In certain embodiments, hub 152 comprises a circumferential surface 152*b* about which the flexible member 11 may be wound. In certain embodiments, hub 152 comprises an axis hole 152*a* into which a suitable axle, such as shaft member 151, may be inserted in order to rotatably retain hub 152. In certain embodiments, the second end 11*b* of the flexible member 11 may be operatively connected to hub 152. The retraction device 150 may further comprise a biasing member 153, such as, for example, a spring or spring loaded bushing, operatively coupled to hub 152 to enable the selective or automatic retraction of at least a portion of the flexible member 11. The biasing member 153 may urge hub 152 to rotate in a first direction. The rotation of hub 152 in the first direction may cause the flexible member 11 to be wound about circumferential surface 152*b* thereby causing the retraction of at least a portion of the flexible member 11 into the housing 60. In certain embodiments, and without limitation, the retraction device 150 may further comprise one or more of a spacer 154, and spacer 155, a spring 156, a clip 157, and a pin 158. In certain embodiments, the biasing member 153 may comprise a clock spring, a torsion spring, another type of spring, or similar mechanism which will operate to enable the selective or automatic retraction of at least a portion of the flexible member 11. In certain embodiments, the biasing member 153 may operate similarly to the springs in tape measures or other mechanisms adapted to permit selective or automatic rewinding of a component.

In certain embodiments, both handles 12 and 13' may comprise either or both of a retraction device 50 or a retraction device 150.

With reference to FIGS. 7, 8, and 12, in the certain embodiment, the housing 16 may comprise a latch mechanism 56 secured to the housing 16 or housing 60 or second handle 13'. The latch mechanism 56 may comprise a device suitable for selectively attaching the cocking device 10 to the clothing or equipment of the associated user. In one embodiment, the latch mechanism 56 may be rotatably connected to the outer surface of the housing 16 or housing 60 or second handle 13'. The latch mechanism 56 may be adapted to receive a portion of the clothing or equipment, such as, for example, a belt loop or pack strap, of the associated user to selectively retain the cocking device 10 suspended therefrom during periods of non-use thereby allowing the cocking device 10 to be conveniently carried and borne by the associated user. In a more specific embodiment, the latch mechanism 56 may comprise a hook, or similar device, having a latch 56*a* biased to normally enclose the opening defined thereby to at least partially prevent the unintentional detachment of the cocking device 10 from the clothing or equipment of the associated user. In another embodiment, the latch mechanism 56 may be connected to a string, rope, cord, or similar item, that can be extended and retracted from within the housing 16 or housing 60 or second handle 13' in a manner similar to the retraction of the flexible member 11 described above.

With reference now to FIGS. 1-12, to utilize a cocking device 10 to draw the bowstring 2, the first and second hook members 14, 15 may be selectively attached to the bowstring 2 utilizing the coupling assembly 17, step 110. In one embodiment, the crossbow 1 may be positioned substantially vertically with the beam 5 upright. In certain embodiments, the crossbow 1 may be positioned substantially vertically with the beam 5 upright such that the bow limbs 3 rest against the ground and the barrel 7 extends substantially perpendicular therefrom or generally upward from the ground. The first and second hook members 14, 15 may be selectively attached to the bowstring 2 such that the first and second hook members 14, 15 are positioned adjacent to opposing sides of the main beam 5. The positioning of the first and second hook members 14, 15 adjacent to opposing sides of the main beam 5 may cause the first and second handles 12, 13 or the first and second handles 12, 13' to also be positioned adjacent to opposing sides of the main beam 5 wherein the first and second hook members 14, 15 are positioned between the first and second handles 12, 13 or the first and second handles 12, 13'. The flexible member 11 may be adjusted such that a first length 11*c* of the flexible member 11 is caused to extend between the first and second hook members 14, 15, step 112. The first length 11*c* may comprise a length suitable to allow the first length 11*c* to be positioned or looped around a portion of the main beam 5, step 114. In one embodiment, the first portion 11*c* of the flexible member 11 may be positioned or looped around an upper portion of the stock 6 located behind the trigger assembly 4. In another embodiment, the first portion 11*c* of the flexible member 11 may be positioned or looped around a lower rearward portion of the stock 6. The first portion 11*c* can be positioned or looped around any portion or component of the crossbow 1 chosen with sound judgment by a person of ordinary skill in the art that allows the bowstring 2 to be drawn and selectively retained by the trigger mechanism 4.

With continued reference to FIGS. 1-12, the associated user may then grasp the first and second handles 12, 13 or the first and second handles 12, 13' and exert a generally rearward force by pulling substantially simultaneously on the first and second handles 12, 13 or the first and second handles 12, 13', step 116. In certain embodiments, the portable cocking device may provide some mechanical advantage affecting the generally rearward force needed to draw the bowstring 2. In certain embodiments, as will be described more fully herebelow, the generally rearward force may be substantially less than the draw weight of the crossbow. The slidably coupled first and second hook members 14, 15 may enable the even distribution of the pulling force being transferred to the bowstring 2 resulting in the even drawing of the bowstring 2. In the first embodiment, the coupling of the second handle 13 and the first and second hook members 14, 15 permits the second handle 13 and the first and second hook members 14, 15 to slide substantially freely along the flexible member 11 thereby ensuring that the bowstring 2 is drawn in a balanced manner, step 118. In the first embodiment, uneven distribution of the pulling force may cause the sliding movement of the second handle 13, the first hook member 14, and/or the second hook member 15 relative to the flexible member 11 thereby causing the bowstring 2 to be drawn in a balanced manner. In the second embodiment, the coupling of the first and second hook members 14, 15 permits the first and second hook members 14, 15 to slide substantially freely along the flexible member 11 thereby ensuring that the bowstring 2 is drawn in a balanced manner, step 118. The generally rearward force may cause the movement of the bowstring 2 towards the butt portion 6' of the stock 6 until the bowstring 2 is engaged and retained by the trigger mechanism 4, step 120. Upon engagement of the bowstring 2 by the trigger mechanism 4, the cocking device 10 can be disengaged from the crossbow 1 thereby allowing the subsequent firing of the crossbow 1, step 122. In the first embodiment, the disengagement of the cocking device 10 from the crossbow 1 may cause the retraction device 50 to retract at least a portion of the flexible member 11 into the housing 16, step 124. In the second embodiment, the disengagement of the cocking device 10 from the crossbow 1 may cause the retraction device 50 to retract at least a portion of the flexible member 11 into the second handles 13', step 124. In the first embodiment, the retraction device 50 may cause the retraction of the flexible member 11 such that the second handle 13 and the first and second hook members 14, 15 are moved towards the first end 11*a* of the flexible member 11. In the second embodiment, the retraction device 50 may cause the retraction of the flexible member 11 such that the first and second hook members 14, 15 are moved towards the first end 11*a* of the flexible member 11.

In another equally acceptable way of using the a cocking device 10 to draw the bowstring 2, step 110 may be performed after step 114 and before step 116. That is, another equally acceptable way of using the a cocking device 10 to draw the bowstring 2, comprises the steps of adjusting the flexible member 11 such that a first length 11*c* of the flexible member 11 is caused to extend between the first and second hook members 14, 15, step 112; positioning or looping the first length 11*c* around a portion of the main beam 5, step 114; attaching the first and second hook members 14, 15 to the bowstring 2 utilizing the coupling assembly 17, step 110; and then proceeding with steps 116 through 124 as noted above.

The retraction of the flexible member 11 may cause the movement of the second handle 13 or 13' towards the first end 11*a* of the flexible member 11 and therefore towards the first handle 12. The movement of the second handle 13 or 13' towards the first end 11*a* may cause opposite poles of the first and second magnets 46, 47 to urge the first and second handles 12, 13 or the first and second handles 12, 13' together into a stowed position. In certain embodiments, the first and second handles 12, 13 or the first and second handles 12, 13' may comprise mechanical fasteners (not shown) to hold the first and second handles 12, 13 or the first and second handles 12, 13' together into a stowed position. Mechanical fasteners (not shown) may comprise a clip, a clamp, a catch, a hoop and loop fastener, or other mechanical fasteners. In certain embodiments, a cocking device 10 may comprise mechanical fasteners (not shown) to hold the first and second handles 12, 13 or the first and second handles 12, 13' together into a stowed position in addition to or in the alternative to the first and second magnets 46, 47. The stowed position may comprise a position that allows for the convenient storage and transport of the cocking device 10. The cooperation of the retraction device 50 and the first and second magnets 46, 47 may urge the cocking device 10 into the stowed position when the first and second hook members 14, 15 are not engaged with the bowstring 2. In the first embodiment, the stowed position may comprise a position wherein the further retraction of the flexible member 11 is prevented by the positioning of the second handle 13 relative to the housing 16 and the first end 11*a* of the flexible member 11. The second handle 13 may be positioned in contact with the first handle 12 and the first and second hook members 14, 15 may be positioned adjacent to the ends of the stem portions 21 of the first and second handles 12, 13, as shown in FIGS. 2 and 3. In the second embodiment, the stowed position may comprise a position wherein the further retraction of the flexible member 11 is prevented by the positioning of the second handle 13' relative to the first end 11*a* of the flexible member 11.

The above description of a method of utilizing a cocking device 10 to draw the bowstring 2 provides a method wherein the cocking device 10 is used in a manner that provides a substantial mechanical advantage to the associated user. That is, without limitation, and as shown in FIGS. 1, 6, 7, and 12, a user pulling on each of the two handles, 12 and 13 or 12 and 13', with some force X, will exert four times that force, 4X, less some minor losses due to friction, heat, hysteresis and the like, on the bowstring 2. In other words, the practical mechanical advantage may approach the theoretical mechanical advantage of 2.

In some embodiments, the first portion 11*c* of the flexible member 11 that is positioned or looped around an upper portion of the stock 6, may interface with stock 6 in a manner that provides for substantial friction, adhesion, or other holding forces so that the first portion 11*c* of the flexible member 11 will not substantially slip or move with respect to the stock 6 during use. In certain embodiments, the first portion 11*c* of the flexible member 11 may comprise a material that promotes friction forces or adhesive forces between it and stock 6. In some embodiments, the first portion 11*c* of the flexible member 11 that is positioned or looped around an upper portion of the stock 6, may interface with stock 6 in a manner that provides for substantial slippage or motion so that the first portion 11*e* of the flexible member 11 may move, slip, or slide with respect to the stock 6 during use. In certain embodiments, the first portion 11*c* of the flexible member 11 may comprise a material that promotes movement or lubrication or diminishes friction between the first portion 11*c* of the flexible member 11 and stock 6.

In some embodiments, and without limitation, the above description of a method of utilizing a cocking device 10, provides a pulley system or a mechanically similar system with more than two pulleys or mechanically similar elements (not shown). In some embodiments, and without limitation, the above description of a method of utilizing a cocking device 10, provides a pulley system or mechanically similar system with two or more suspended pulleys or mechanically similar elements in each of the hook members 14, 15 (not shown). In some embodiments, and without limitation, the above description of a method of utilizing a cocking device 10, provides a pulley system or a mechanically similar system with a plurality of pulleys or mechanically similar elements engagable to the stock 6 (not shown). In some embodiments, and without limitation, the above description of a method of utilizing a cocking device 10, provides a compound pulley system with a plurality of pulleys engagable to the stock 6 (not shown).

In some embodiments, and without limitation, the first and second hook members 14, 15 may be integrally connected, coupled together, or otherwise joined into a single unit (not shown).

The embodiments have been described, hereinabove. It will be apparent to those skilled in the art that the above methods and apparatuses may incorporate changes and modifications without departing from the general scope of the present subject matter. It is intended to include all such modifications and alterations in so far as they come within the scope of the appended claims or the equivalents thereof.

What is claimed is:

1. A device comprising:

a first handle connected to a first end of a flexible member;

a second handle slidably engaged with the flexible member, wherein the first and second handles are adapted to be grasped by a user;

a housing, integral with the second handle, and comprising a retraction device operatively connected to a second end of the flexible member, wherein the retraction device is adapted to retract at least a portion of the flexible member into an interior portion defined by the housing;

a first hook member slidably coupled to the flexible member, wherein the first hook member comprises a first attachment assembly and a first coupling assembly;

a second hook member slidably coupled to the flexible member, wherein the second hook member comprises a second attachment assembly and a second coupling assembly;

wherein the first and second hook members are positioned between the first and second handles;

wherein the first and second attachment assemblies are adapted to receive at least a portion of an associated crossbow bowstring;

wherein the first and second coupling assemblies are adapted to at least partially enable the movement of the first and second hook members, respectively, along at least a portion of the flexible member;

wherein the retraction device comprises:

a shaft member rotatably coupled to the housing;

a pair of end plates connected to ends of the shaft member, wherein the end plates rotate in conjunction with the shaft member and retain at least a portion of the flexible member retracted into the housing; and, a biasing member operatively connected to the shaft member to urge the shaft member to rotate in a first direction, wherein rotation of the shaft member in the first direction causes the flexible member to wind around a circumference of the shaft member between the pair of end plates.

2. The device of claim 1, wherein the housing is disposed internally in the second handle.

3. The device of claim 1, wherein:

the first coupling assembly comprises a first spindle positioned at least partially within the first hook member; and, the second coupling assembly comprises a second spindle positioned at least partially within the second hook member.

4. The device of claim 1, wherein:

the first attachment assembly comprises a first hook-shaped appendage extending from a second end of the first hook member; and, the second attachment assembly comprises a second hook-shaped appendage extending from a second end of the second hook member.

5. The device of claim 4, wherein:

the first hook-shaped appendage comprises a first latch;

the second hook-shaped appendage comprises a second latch; and, the first and second latches are each biased to normally enclose an opening of one of the hook-shaped appendages to at least partially assist in retaining the bowstring.

6. The device of claim 1, further comprising:

a first magnet positioned at least partially within or coupled to the first handle;

a second magnet positioned at least partially within or coupled to the second handle; and, wherein the first and second magnets are positioned to cause the first handle to be urged into contact with the second handle.

7. The device of claim 1, wherein the retraction device further comprises:

a ratchet gear; and, a pawl, wherein the ratchet gear and the pawl cooperate to selectively prevent the rotation of the shaft member in the first direction.

8. The device of claim 1, further comprising:

a latch mechanism for selectively attaching the device to the clothing or equipment of an associated user.

9. A crossbow cocking apparatus comprising:

a first handle connected to a first end of a flexible member;

a second handle operatively connected to a second end of the flexible member, wherein the first and second handles are adapted to be grasped by a user, the second handle comprising:

a refraction device connected to the second end of the flexible member, wherein the retraction device is configured to retract at least a portion of the flexible member into an interior portion of the second handle, wherein the retraction device comprises, a shaft member rotatably coupled to the interior portion of the second handle, first and second end plates operably coupled to first and second ends of the shaft member, respectively, wherein the first and second end plates are configured to rotate in conjunction with the shaft member and retain at least a portion of the flexible member retracted into the interior portion of the second handle, and, a biasing member operatively connected to the shaft member and configured to urge the shaft member to rotate in a first direction, wherein rotation of the shaft member in the first direction causes the flexible member to wind around a circumference of the shaft member between the first and second end plates, a first hook member slidably coupled to the flexible member, and configured to selectively engage a first portion of an associated crossbow bowstring;

a second hook member slidably coupled to the flexible member, and configured to selectively engage a second portion of the associated crossbow bowstring;

wherein the first handle and the second handle respectively comprise a coupling device configured to selectively engage the said first handle with the second handle, the coupling device comprising, a first magnet fixedly engaged with the first handle, and, a second magnet fixedly engaged with the second handle.

10. A method for cocking a crossbow comprising the steps of:

selectively engaging a first hook member of a crossbow cocking device with a first portion of a bowstring of a crossbow, wherein the first hook member is slidably engaged with a flexible member of the crossbow cocking device;

extending the flexible member from a housing operably engaged with a second handle of the crossbow cocking device, wherein the housing comprises a retraction device connected to a second end of the flexible member, wherein the retracting device is configured to:

allow the flexible member to be extended from the housing during a crossbow cocking operation; and, retract at least a portion of the flexible member into the housing outside of the crossbow cocking operation;

selectively engaging a second hook member of the crossbow cocking device with a second portion of the bowstring of the crossbow, wherein the second hook member is slidably engaged with the flexible member of the crossbow cocking device;

selectively engaging a portion of the flexible member with a portion of the crossbow between the first hook member and the second hook member; and cocking the bowstring on the crossbow comprising:

grasping a first handle connected to a first end of the flexible member;

grasping the second handle; and exerting a rearward force on the first and second handles at least until the bowstring is disposed in a cocked position with regards to the crossbow;

wherein the refraction device is configured to retract at least a portion of the flexible member into the housing by urging a shaft member to rotate in a first direction, wherein rotation of the shaft member in the first direction at least partially causes the retraction of the flexible member and the shaft member is rotatably coupled to the housing and a biasing member is operatively connected to the shaft member to urge the shaft member to rotate in the first direction and the rotation of the shaft member in the first direction causes the flexible member to be wound around the circumference of the shaft member.

11. The method of claim 10, wherein the second handle is slidably coupled to the flexible member.

12. The method of claim 10, wherein the housing is disposed internally in the second handle.

13. The method of claim 10, wherein the cocking device further comprises a latch mechanism for selectively attaching the cocking device to the clothing or equipment of an associated user and the method further comprises the step of:

attaching the cocking device to the clothing or equipment of the associated user.

14. The method of claim 10, further comprising actuating a pawl, wherein the pawl is normally engaged with a ratchet gear operatively connected to the shaft member to selectively mitigate rotation of the shaft member in the first direction and the actuation of the pawl causes the pawl to be disengaged from the ratchet gear to at least partially cause the retraction of the flexible member.

15. The method of claim 10, wherein the first handle and the second handle respectively comprise a coupling device configured to selectively engage the first handle with the second handle, the coupling device comprising:

a first magnet fixedly engaged with the first handle; and a second magnet positioned at least partially within or coupled to the second handle.

* * * * *